US006068724A

United States Patent [19]

Barny et al.

[11] Patent Number: 6,068,724

[45] **Date of Patent: *May 30, 2000**

[54] MACHINE AND METHOD FOR MANUFACTURE OF A SHEET OF SINGLE-FACE CORRUGATED BOARD BY GLUING UNDER TENSION

[75] Inventors: Jean-Jacques Barny, Villefranche; Jean-Marie Paultes, Paris; Louis Baillet, Brigueuil, all of France

[73] Assignee: OTOR, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/581,549

[22] PCT Filed: May 5, 1995

[86] PCT No.: PCT/FR95/00586

§ 371 Date: Jan. 5, 1996

§ 102(e) Date: Jan. 5, 1996

[87] PCT Pub. No.: WO95/30537

PCT Pub. Date: Nov. 16, 1995

[30] Foreign Application Priority Data

May 6, 1994 [FR] France ..... 94/05611

[51] Int. Cl.[7] ..... B31F 1/28

[52] U.S. Cl. ..... 156/205; 156/210; 156/471; 156/472; 156/473

[58] Field of Search ..... 156/205, 210, 156/471, 472, 473

[56] References Cited

U.S. PATENT DOCUMENTS

| | | | |
|---|---|---|---|
| 1,186,998 | 6/1916 | Langston . | |
| 1,199,508 | 9/1916 | Swift, Jr. | 156/205 |
| 2,638,962 | 5/1953 | Nitchie | 156/473 |
| 2,710,045 | 6/1955 | Bruker | 156/472 |
| 2,742,079 | 4/1956 | Hall . | |
| 2,960,144 | 11/1960 | Graf | 156/472 |
| 3,189,507 | 6/1965 | Long . | |
| 3,479,240 | 11/1969 | Moser . | |
| 3,811,987 | 5/1974 | Wilkinson et al. | 156/471 |
| 3,981,758 | 9/1976 | Thayer et al. . | |
| 4,059,474 | 11/1977 | Coburn | 156/578 |
| 4,086,116 | 4/1978 | Yazaki et al. . | |
| 5,614,048 | 3/1997 | Barny et al. | 156/205 |

FOREIGN PATENT DOCUMENTS

| | | | |
|---|---|---|---|
| 62 2805 | 12/1966 | Belgium . | |
| 0 038 237 | 10/1981 | European Pat. Off. . | |
| 0 064 939 | 11/1982 | European Pat. Off. . | |
| 0 261 246 | 3/1988 | European Pat. Off. . | |
| 0 279 609 | 8/1988 | European Pat. Off. . | |
| 0 492 310 | 7/1992 | European Pat. Off. . | |
| 536518 | 4/1993 | European Pat. Off. | 156/472 |
| 0 559 556 | 9/1993 | European Pat. Off. . | |
| 25 27 819 | 12/1976 | Germany . | |
| 195 46 767 | 2/1997 | Germany . | |
| 5-138776 | 6/1993 | Japan . | |
| 1052659 | 12/1966 | United Kingdom . | |
| WO 95/03166 | 2/1995 | WIPO . | |

*Primary Examiner*—Michael W. Ball
*Assistant Examiner*—Gladys Piazza
*Attorney, Agent, or Firm*—Merchant & Gould P.C.

[57] ABSTRACT

Machine (1) and method of manufacture of a single-face corrugated board sheet whereby a fluted cardboard sheet (23) is glued to a flat sheet. The machine comprises three heating cylinders having parallel axes, tangently arranged pairwise and means (26) for positive traction driving the corrugated board sheet, said means being located downstream of the path of the corrugated board in relation to the three cylinders. The fluted sheet is pressed onto the cylinder downstream of the first contact (29) between the flat sheet and the fluted sheet, in an arc of a circle corresponding to an angle at the center (alpha) of a first predetermined value greater then zero. Said positive driving means are associated with complementary means for heating said corrugated board.

23 Claims, 3 Drawing Sheets

MACHINE AND METHOD FOR MANUFACTURE OF A SHEET OF SINGLE-FACE CORRUGATED BOARD BY GLUING UNDER TENSION

FIELD OF THE INVENTION

The present invention relates to the manufacture of corrugated board and more particularly a machine for manufacture of a sheet of single-face corrugated board by gluing a fluted sheet of board onto a plane sheet of board, known as the cover sheet, of the type comprising three heating cylinders which are substantially tangent in pairs and have parallel axes, namely a first, fluted cylinder for preforming the fluted sheet, a second, fluted, central cylinder associated with means for applying the fluted sheet against the external wall of the said second cylinder upstream of the first contact between plane sheet and fluted sheet, and a third, smooth cylinder for bringing the plane sheet into contact with the flutes of the fluted sheet at the periphery of the second cylinder, as well as means for gluing the flutes before contact between plane sheet and fluted sheet.

It also relates to a method of manufacture of sheets of single-face corrugated board, especially using a machine of the type hereinabove.

It finds one particularly important, although not exclusive, application in the field of the high-speed manufacture of single-face sheet, for example with board obtained from recycled paper with low grammage (less than of the order of 150 g/m$^2$).

BACKGROUND OF THE INVENTION

Machines of the type defined hereinabove are already known.

Thus, FIG. 1 represents a machine 1 of the prior art in a production line 2 for single-face corrugated board.

The line comprises feed means 3 and 4 respectively for plane sheet, cover sheet and plane sheet intended to form the fluted sheet.

These feed means comprise, in a manner which is known per se, unwinders for reels 5 which allow good control of the unwinding and of the braking which are necessary for the manufacture of the board.

They also comprise a preheater 6 for the cover sheet, generally consisting of a steel cylinder heated by steam and fitted with small rolls called "turn rolls" which serve to alter the paper/cylinder contact surface area, and a preconditioner 7 for the fluted sheet, which, for its part, furthermore comprises a boom for wetting the sheet, which promotes the formation of the flutes.

The line 2 moreover comprises means 8 for removing the single-face board obtained, which means consist of a system of belts at the top part of the line.

FIG. 2 more precisely shows, in section, the single-face machine 1 of the line in FIG. 1.

It comprises, on the fluted-sheet feed side, an additional preheating cylinder 9 and a wetting cylinder 10, and, on the cover-sheet feed side, two rotating preheating cylinders 11.

The machine 1 moreover comprises a first, upper, fluted cylinder 12 made of stainless steel. It is hollow and arranged to be heated by steam in a manner which is known per se.

The machine 1 also comprises a second, fluted, central cylinder 13 made of stainless steel, of axis parallel to that of the first cylinder substantially tangent to the latter and, for example, of the same diameter.

The second cylinder is, for example, of the type known by the brand name "Air Drive" manufactured by the French company MARTIN.

It comprises two chambers, namely a central chamber heated by steam and a vacuum chamber 15 connected to a depressurization device 16. The chamber comprises channels 17 pierced over the entire length of the cylinder and communicating with the fluted peripheral surface via holes.

The machine 1 comprises a third, lower cylinder 18 of smooth surface, of axis parallel to the first two and, for example, of the same diameter. This cylinder is heated by steam in a manner similar to the first two and is arranged to compress the cover sheet against the ridges of the flutes of the fluted sheet, in contact with the periphery of the central fluted cylinder, as will be seen further on.

The machine 1 moreover comprises means 19 for gluing the crests of the flutes, which means are known per se, comprising a calender roll 20, an adhesive tank 21 and a gluing roll 22.

The principle of operation of the machine 1 is as follows.

Two sheets or layers of paperboard 23 and 24 are introduced into the machine 1.

The sheet 23 is intended to form the fluted sheet.

After drying and wetting treatment at 7, 9 and 10, it passes around the first fluted heating cylinder 12 over a part of its periphery.

It is then introduced between the two fluted heating cylinders 12 and 13 which turn in mutually opposite directions as two meshing cylinders.

The vacuum created in the lower cylinder 13 then presses the fluted sheet 23 formed against the heating cylinder over a circle arc having a vertex angle equal to of the order of 180°.

During passage in front of the adhesive-application roll 22, a line of adhesive is, moreover and as has been seen, deposited on the crest of the flutes.

The adhesive is, for example, based on starch.

The cover sheet 24 is, for its part, introduced at the bottom and on the opposite side of the machine 1.

It is predried at 11 and wound around the third cylinder 18, also called the smooth press. A very high hydraulic pressure, for example 5 kg/cm (linear pressure) ensures successive contact at 25 (see FIG. 3) between each upper ridge of the flutes of the fluted sheet 23 and the cover sheet 24 made of smooth paper.

The adhesive joint is therefore obtained by the combined action of the high pressure and the temperature in a fraction of a second.

The fluted sheet is moved by the meshing of the fluted cylinders 12 and 13, and the cover sheet is moved by clamping between the central cylinder 13 and the smooth cylinder 18, no tension being exerted downstream of the three cylinders. The corrugated board is subsequently removed at the top, in a manner which is known per se, by a conveyor belt.

Other types of single-face machines exist, such as, for example, those in which the fluted sheet is pressed flat by air instead of being sucked by vacuum onto the central cylinder.

Their principle of operation and the structural elements which they employ remain, however, substantially identical to those described hereinabove.

Although they make it possible to achieve high throughput while giving acceptable single-face paper, known machines nevertheless still have drawbacks.

In particular, in order to obtain good adhesive bonding, which is the aim sought if high-quality corrugated board is desired, it has to date essentially been considered necessary to apply the two sheets against one another with a very high pressure, moreover given that a sufficient temperature is maintained at the moment of the adhesive bonding in order to allow gelatinization of the adhesive.

Unfortunately, and importantly, this pressure has detrimental effects.

It is in fact applied onto the upper part of the crests of the flutes (see FIG. 3), which causes cuts in the board, in particular at resonant speeds, or even at high speeds.

Furthermore, since the application of the press cylinder 18 onto the central fluted cylinder 13 takes place discontinuously, from one flute to the next, vibrations and intense noise (105 to 110 decibels at high speed) are generated.

This results in poor-quality corrugated board, in which the characteristics of resistance to moisture and bursting of the cover, for example, are degraded.

It is also known (EP 0559556) a device for manufacturing corrugated board comprising means allowing the wrap around of the board according to a winding angle on the central fluted cylinder and means for heating such board situated downstream.

Such a device is only directed to be used with boards connected to each other end to end and excludes any possibilities of tension or traction on the liner board per se.

Also, it is known (U.S. Pat. No. 2,638,962 and U.S. Pat. No. 4,480,066) to use belts for driving away the paper when the corrugated board is formed, or a vacuum table to avoid any shearing strength between the liner board and the fluted board at the level of the glue joints.

Such device and process need however to press the paper on a plurality of adjacent flutes of the central fluted cylinder, which involves systematic wear and the usual difficulties to use such systems.

SUMMARY OF THE INVENTION

The present invention aims to provide a machine and a method for manufacturing single-face corrugated board which respond better than those previously known to the practical requirements, especially in that the invention makes it possible practically to eliminate cuts of paper at the resonant speeds and/or at high speed, that is to say, for example, greater than 300 m/min, and in that it makes it possible to obtain excellent adhesive bonding, which produces corrugated board with improved performance, while at a low cost and in a manner which is easy to implement.

The existing machines may, moreover, be easily adapted to profit from the improvement constituted by the present invention.

In order to do this, the present invention is based on an idea consisting, in particular, in minimizing or eliminating the pressure between the fluted cylinder 12 and the smooth cylinder 18 over the contact surface between the sheets, by replacing the high pressure by extended heating of the sheets against one another, while exerting simultaneously a constant or substantially constant tension downstream on the plane sheet of corrugated board formed, said tension or traction being arranged to press said sheet of corrugated board against the fluted cylinder.

To this end, the present invention provides, in particular, a machine for manufacture of a sheet of single-face corrugated board by gluing a fluted sheet of board onto a plane sheet of board, comprising Three heating cylinders which are substantially tangent in pairs and have parallel axes, namely a first, fluted cylinder for preforming the fluted sheet, a second, fluted, central cylinder fitted with means for applying the fluted sheet against the external wall of the said second cylinder upstream of the first contact between plane sheet and fluted sheet, and a third, smooth cylinder for bringing the plane sheet into contact with the flutes of the fluted sheet at the periphery of the said second cylinder, and means for gluing the said flutes before the said contact, characterized in that it furthermore comprises means, for positive driving by tension of the plane sheet of corrugated board, with a strength equal or greater than of the order of 4N/cm, which are entirely located downstream of the path of the corrugated board with respect to the three cylinders, the said positive drive means and the second cylinder being arranged to press the fluted sheet flat onto the external wall of the said second cylinder downstream of the said first contact between plane sheet and fluted sheet, along a circle arc corresponding to an angle at the centre alpha of a first determined value greater than zero, the said positive drive means being associated with means for complementary heating of the corrugated board.

In other words, the means of positive driving the fluted board on the central fluted cylinder with a strength having a radial component directed toward the centre of the central cylinder, for instance comprised between 0.1 and 3N/cm, for instance of 1N/cm.

In advantageous embodiments, resort is further made to one and/or other of the following arrangements:

the means for complementary heating of the corrugated board are separate from the positive drive means and are located upstream of the said positive drive means;

the means for positive driving are remote from the central cylinder such as the corrugated board extends on a straight distance between them, of a length greater than several centimeters, for instance equal to of the order of 20 cm, or 50 cm or 1 m. Such a disposition allows a correct penetration of the glue in the paper.

the device comprises means arranged to monitor and control the temperature of the paper board and then of the heating cylinders according to the rotational speed of the cylinders, to keep constant the transfer of heating calories, via a controlling and monitoring system known by itself, including for instance infrared captors arrange to control the speed of the rotating motors of the cylinders;

the means for positive driving by tension of the sheet of corrugated board and the complementary heating means comprise a fourth heating cylinder provided with means for applying the sheet of corrugated board against the external wall of the said fourth cylinder, of axis parallel to the other cylinders, the said fourth cylinder being arranged to be itself in contact with the back of the plane sheet over a circle arc corresponding to an angle at the centre beta of a second determined value greater than zero.

In view of the use of means for applying the sheet of corrugated board against the wall of the fourth cylinder, this results in impossibility or near impossibility of sliding of the corrugated board at the positive drive means (tolerance of the order of +5% maximum).

Other positive drive means may moreover be provided such as, for example, rolls elastically pinching the corrugated board between them, directly downstream of the second cylinder, simultaneously with or after the complementary heating.

Advantageously, the fourth cylinder is arranged to press the fluted sheet flat onto the said second cylinder downstream of the said first contact between plane and fluted sheets.

the application means associated with the fourth cylinder are means for suction of the corrugated board, via orifices pierced in the surface of the wall of the said fourth cylinder, the fourth cylinder having a smooth or substantially smooth surface over its entire periphery;

the second determined value lies between of the order of 90° and of the order of 270°;

the second determined value is of the order of 180°;

the positive drive means comprise means for actuating the fourth cylinder in rotation at a determined speed lying between of the order of 1 and of the order of 1.05 times the speed of rotation of the second cylinder, for example 1.03 times.

Advantageously, the overspeed of the fourth cylinder or of the other types of drive means, if it exists, is less than 1%, for example equal to of the order of 0.5% of the speed of the second cylinder or of the speed of advance of the board. This overspeed makes it possible to take into account the wear of the cylinders and increase the working life of the latter;

the fourth heating cylinder has the same diameter as the first three heating cylinders;

the positive drive means and the second cylinder are arranged to allow adjustment of the angle alpha of winding of the sheet of corrugated board onto the second cylinder.

Such an arrangement makes it possible to adjust the heating of the corrugated board formed as a function of the speed of advance, which makes it possible, in particular, to avoid overheating of the board, for example at the start of manufacture or at the end of manufacture of the corrugated board;

the fourth cylinder is arranged to allow adjustment of the angle beta of winding of the sheet of corrugated board onto the fourth cylinder;

the machine furthermore comprises a smooth cylinder of small diameter, of axis parallel to the axis of the heating cylinders, and located downstream of the cylinders on the path of the corrugated board and below the horizontal plane tangent to the upper generatrix of the fourth cylinder;

the first determined value alpha is greater than of the order of 30°, and advantageously greater than 100°;

the first determined value corresponds to an arc dimension at the surface of the second cylinder greater than of the order of 50 mm;

the machine comprises means for adjusting the pressure exerted on the sheet of corrugated board, at the second cylinder, by the third, smooth cylinder, below a determined threshold value of 3 kg/cm;

the machine comprises means for adjusting the distance between the surfaces of the second and third cylinders, the said means being arranged to eliminate any pressure of the third cylinder on the fluted sheets and plane cover sheet of the corrugated sheet, in contact with the second cylinder, during operation of the machine.

No contact therefore exists between the second and third cylinders.

The adjustment means are, for example, spacer means between cylinder peripheries, which are known per se.

Such a system actually gives excellent results at board unwinding speeds greater than 200 m/min.

The invention also provides a method of manufacture of a sheet of single-face corrugated board, using a machine as described hereinabove.

It also provides a method for manufacturing a sheet of single-face corrugated board, from a sheet of fluted board and a plane sheet of board, called the cover sheet, by gluing one onto the other, characterized in that the previously pasted crests of the flutes of the corrugated sheet are kept in contact with the plane sheet, over a first zone formed by a first surface portion of a central, fluted heating cylinder, by pressing the said fluted sheet of the sheet of corrugated board flat against the said first surface portion, downstream of the first contact between plane sheet and fluted sheet, over an arc corresponding to an angle at the centre alpha of a first determined value greater than zero, by exerting a traction or tension equal or greater than of the order of 4N/cm on the plane sheet of corrugated board by positive driving of the said sheet of corrugated board downstream of the path of the corrugated board with respect to the central fluted cylinder, and wherein the sheet of corrugated board is heated in complementary fashion over the path, of the said sheet, located downstream with respect to the said central fluted cylinder.

In advantageous embodiments, resort is further made to one and/or the other of the following arrangements:

the sheet of corrugated board is heated in complementary fashion over the path of the sheet, upstream with respect to the positive drive means;

the said tension is exerted and complementary heating is carried out by means of a second, rotary heating cylinder located downstream of the path of the corrugated board with respect to the central fluted cylinder, by pressing the said cover sheet flat against a surface portion of the said second cylinder, over an arc corresponding to an angle at the centre beta of a second determined value;

the second determined value lies between of the order of 90° and of the order of 270°;

the second determined value is of the order of 180°;

the speed of the said second heating cylinder lies between of the order of 1 and of the order of 1.05 times the speed of rotation of the said central fluted cylinder;

the first determined value is greater than of the order of 30°, and advantageously greater than of the order of 100°;

no external pressure is exerted by the means for conveying the plane cover sheet (for gluing onto the fluted sheet at the central fluted cylinder);

the angle alpha of winding of the sheet of corrugated board onto the central fluted cylinder is adjusted, by respective displacement of the positive drive means with respect to the said central fluted cylinder;

the angle beta of winding of the corrugated board onto the second cylinder located downstream of the path of the corrugated board with respect to the central fluted cylinder is adjusted.

The invention also provides a method for manufacturing a sheet of single-face corrugated board, from a sheet of fluted board having flutes of type B, C or E, and from a plane sheet of board, called the cover sheet, by gluing one onto the other, the said sheets consisting of paper of grammage less than 140 g, advantageously less than 100 g and/or advantageously lying between of the order of 80 g and of the order of 130 g, characterized in that the speed of advance of the board during the said manufacture is greater than 250 m/min, advantageously greater than 350 m/min, preferably greater than 400 m/min and even more preferably greater than 450 m/min, or even 500 m/min.

Flutes of type B, C and E correspond to French Standard NF Q 12-008. They are, in particular, defined in the following manner, e being the overall thickness of the corrugated board in mm:

type B: small flute, 2<e≦3.5;

type C: medium flute, 3.5<e≦4.5;

type E: microflute, e≦2.

The invention will be better understood on reading the description of an embodiment, given hereinbelow by way of non-limiting example.

BRIEF DESCRIPTION OF THE DRAWINGS

The description refers to the accompanying drawings in which, as

DETAILED DESCRIPTION OF THE DRAWINGS

Figure 2:
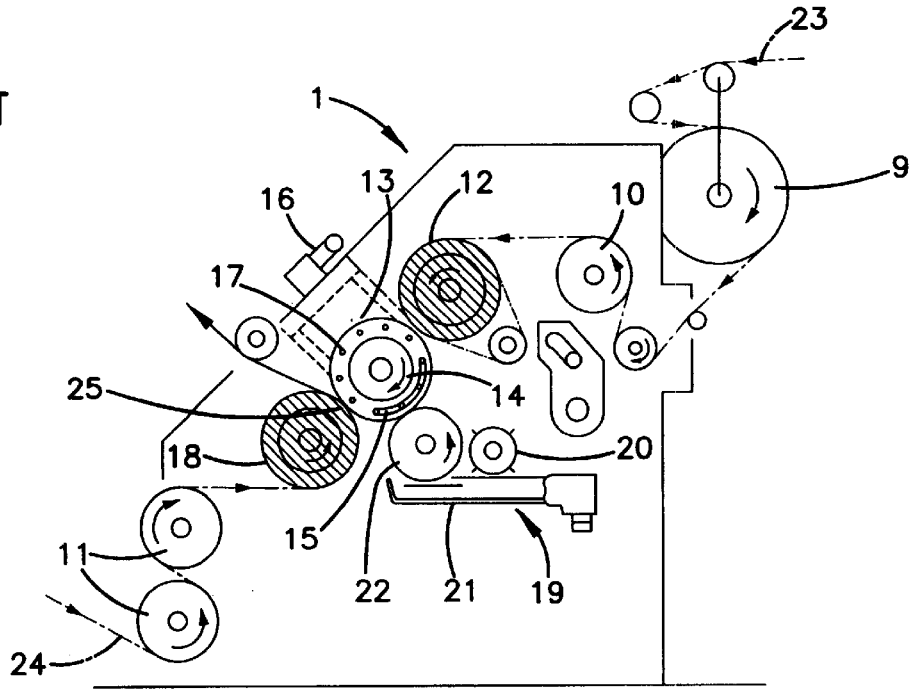
FIG. 2 PRIOR ART

The machine according to the embodiment of the invention more particularly described here comprises, on the one hand, a single-face machine of the type described with reference to FIG. 2 and, on the other hand, a fourth cylinder which will be described with reference to FIGS. 4 and 5.

For simplification, the same reference numbers are used when they denote the same elements.

In addition to the first, second and third cylinders 12, 13 and 18, the machine according to the invention therefore comprises a fourth heating cylinder 26 fitted with a suction-application system 27 which will be described further on.

The cylinder 26 is of axis 28, parallel to the axes of the preceding cylinders and located above the latter, for example directly after the second cylinder on the path of the sheet of corrugated board.

The cylinder 26 is moreover heated by steam in a manner similar to the other cylinders, for example in order to reach a skin temperature of the cylinder lying between 160° C. and 200° C.

It consists of a recessed tube of stainless steel and has, for example, an external diameter identical to the others.

More precisely (see FIG. 5) the cylinder 26 is, for example, here also of the "Air Drive" type, manufactured by the French company MARTIN and known under the reference M 260. It comprises two ends 29 and 30, mounted on bearings 31, and a cylindrical body 32 provided with a central cylindrical recess 33 fed with steam at 34 via one of its ends 30. A channel 35 for removing the condensates is also provided at this end.

The other end 30 of the cylinder 26 comprises rotational drive means 36, using a motor having a nominal operating speed which is fixed with respect to the speed of the second roll of the single-face machine.

The surface 37 of the periphery of the cylindrical body 32 is smooth. The term smooth surface should be understood to mean a non-fluted plane cylindrical surface which may, however, exhibit slight reinforcements or crescents 38, for example in the shape of rectangular slots of 40 mm in length by 2.5 mm in width, the bottom of which is in the shape of a cylinder portion with large radius of curvature. On a cylinder such as the "Air Drive" cylinder of the firm MARTIN, the reinforcements generally occupy less than 5% of the surface area of the cylinder, for example 2.8% and are connected to means 39 for depressurization via two circle-arc chambers 41 connected to longitudinal peripheral channels 42 distributed angularly and connected regularly to the crescents 38 via small radial channels 43. The chambers 41 respectively belong to two fixed distribution rings 44 provided on either side of the cylinder 26, with which they cooperate in rotation, by friction, in a substantially leaktight manner, via their lateral wall.

A vacuum-breaker device 45 for detaching the board by injecting compressed air 47 into the channels 42, facing the point 40, is moreover advantageously provided in a manner which is known per se.

Tension in the sheet of corrugated board is ensured by virtue of the higher speed of the suction cylinder 26, onto which the cover sheet of the corrugated board is pressed flat without possibility or practically without possibility of sliding.

With a machine thus modified, the adhesive bonding is different from the conventional adhesive bonding. Instead of producing the adhesive joint instantaneously by combined action of heat and high pressure, the adhesive bonding is ensured essentially by heat and under longitudinal tension in the direction of advance, the pressure being significantly reduced or even eliminated.

The adhesive is dried in two zones:

a first contact zone 48 between the fluted sheet 23 and the cover sheet 24, in which the two sheets are kept against each other on the central fluted cylinder 13 over a winding angle alpha, for example of approximately 60°.

In the embodiment more particularly described here, the space between the central fluted cylinder 13 and the smooth third cylinder 18, at the contact or junction point 29 of the two sheets, is greater than the maximum thickness of a sheet of corrugated board to be treated, so that the pressure is zero regardless of the type of paper.

Figure 4:
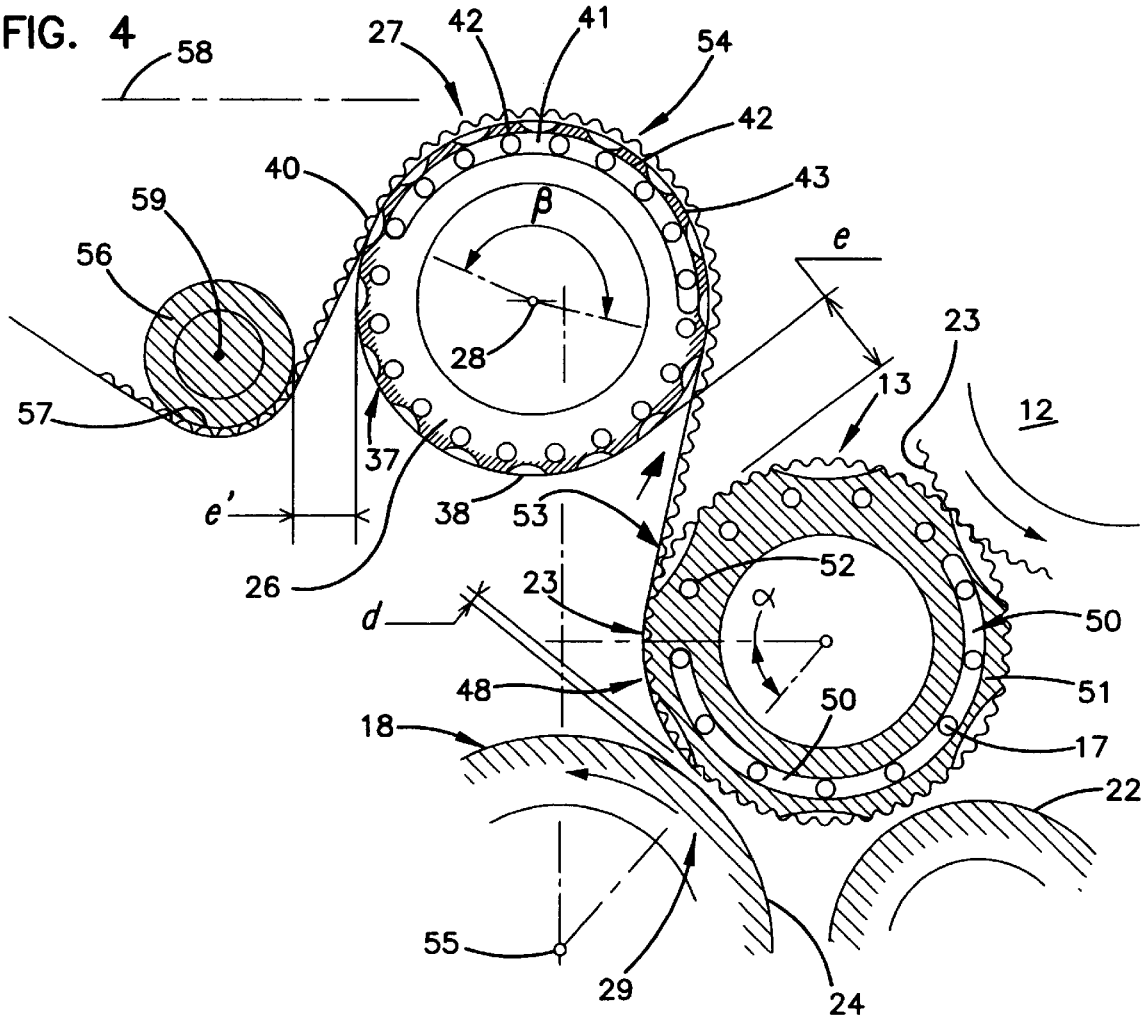
FIG. 4 schematically shows an embodiment of the improvement constituted by the invention, in transverse section.
Figure 5:
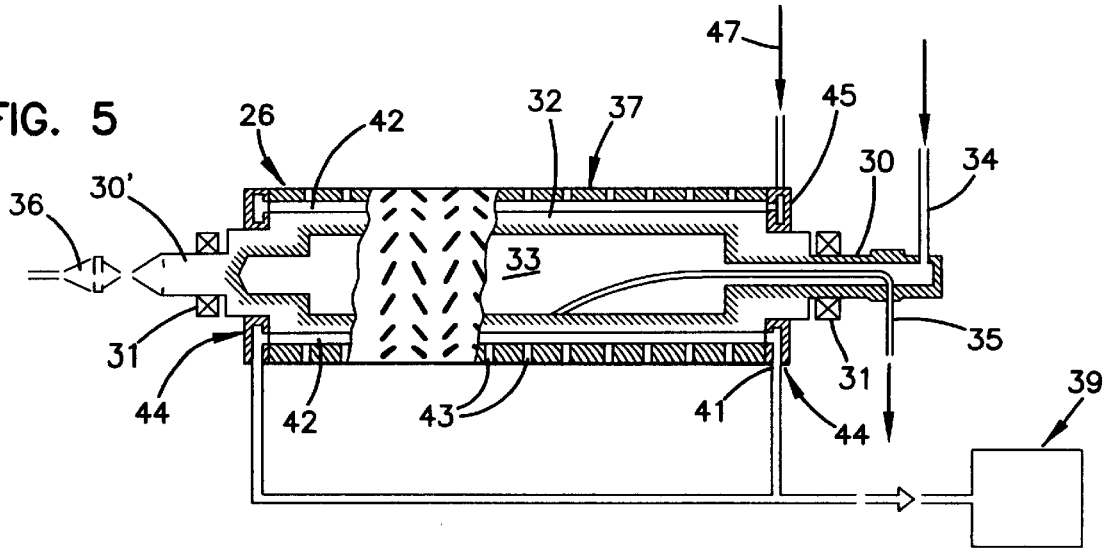
FIG. 5 is a view in longitudinal section, and with partial cutaway, of the fourth cylinder in FIG. 4.

Advantageously, the suction of the sheet of corrugated board onto the central fluted cylinder 13 continues downstream of the contact point 29 by virtue of the extension, over an arc of the order of 60°, of the chamber 50 belonging to the annulus 51 which is schematically represented in FIG. 4 and which is of the type of the ring 44 described with reference to the cylinder 26.

A vacuum-breaker and/or board detachment device (not shown), which is known per se, is also provided in similar fashion at the release point 53 of the sheet of corrugated board;

a second contact zone 54, in which the two sheets are again kept against each other, but this time on the cylinder 26 over a winding angle beta, for example of 180°, which makes it possible to complete the gelatinization and the drying of the adhesive.

V being the speed of advance of the board, VI, the external speed of the cylinder, is, for example, equal to an unadjustable nominal value of 1.05.

In the embodiment more particularly described here, and in order to keep the sheet of corrugated board, on the fluted side, in contact with the fluted surface of the cylinder 13 over an angle alpha, the cylinder 26 also has, at least with respect to the plane tangent to the point 29 of contact with the cylinder 13, a part of its surface on the side of the said cylinder 13.

To this end, the axis 28 of the cylinder 26 may also be located on the side of the cylinder 13, with respect to the vertical plane passing through the axis 55 of the smooth cylinder 18.

A small, smooth and solid non-heating roller 56, which is known per se and can be in contact with the sheet of corrugated board, on the corrugated side, is moreover, for example, provided before return towards the table for removing the sheet of corrugated board formed at the top.

It has, for example, a lower generatrix 57 located below the horizontal plane 58 tangent to the upper generatrix of the cylinder 26.

Advantageously, the axis 59 of the roller 56 is located below the axis 28 of the cylinder 26, and its position can be adjusted vertically in order to make it possible to change the winding angle beta.

Sufficient distances e and e' between lateral walls, respectively of the cylinders 13 and 26, and 26 and roller 56, are moreover provided in order to allow correct unwinding of the sheet of corrugated board formed.

A description will now be given of the operation of the machine according to the embodiment of the invention more particularly described here.

The sheet prefluted by the first heating cylinder 12 is engaged on the second fluted cylinder 13 which sucks it in a manner which is known per se, as described hereinabove, over an angle at the center corresponding to of the order of 240°, i.e. 180° until the point 29 of contact with the plane sheet brought opposite by the smooth cylinder 18, which is also a heating cylinder, and of the order of 60° (angle alpha) downstream of the said contact point 29.

The sheet of corrugated board formed by the previously pasted fluted sheet and the plane sheet therefore remains in contact with the heating cylinder 13 until the point 53, where detachment of the sheet is promoted by a compressed air jet.

The sheet of corrugated board is subsequently taken up again by the smooth fourth cylinder 26, which is a heating and suction cylinder, the cover sheet being on the side of the surface of the said cylinder, which is moreover actuated at a speed slightly greater than that of the second cylinder in order to constitute the means for positive driving by traction on the said sheet of corrugated board downstream of the point 29.

This sheet is sucked by the holes in the surface of the cylinder 26, for example over 180°, before detachment using a blowing jet, deflection by the roll 56 and removal.

The tension force exerted on the corrugated board by the positive drive means is greater than of the order of 4 N/cm, for example of the order of 5 N/cm or of the order of 8 N/cm.

By virtue of the invention, it was possible to observe a significant improvement in the characteristics of the single-face corrugated board produced.

Figure 1:
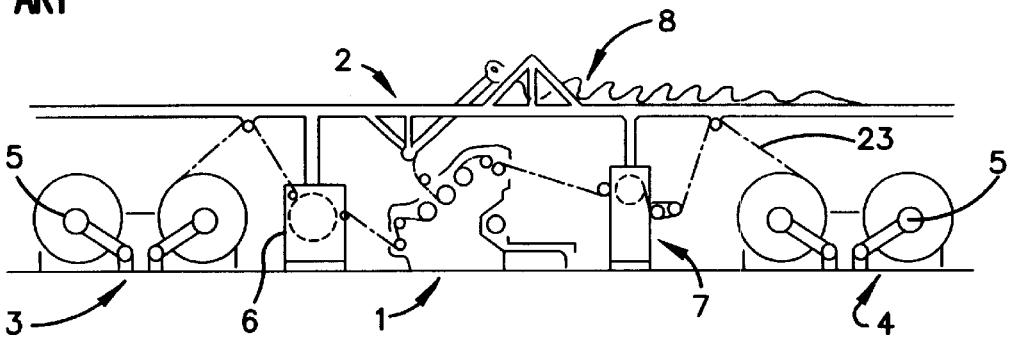
FIG. 1 PRIOR ART
FIGS. 1 to 3 already described and relate to a machine of the prior art.
Figure 3:
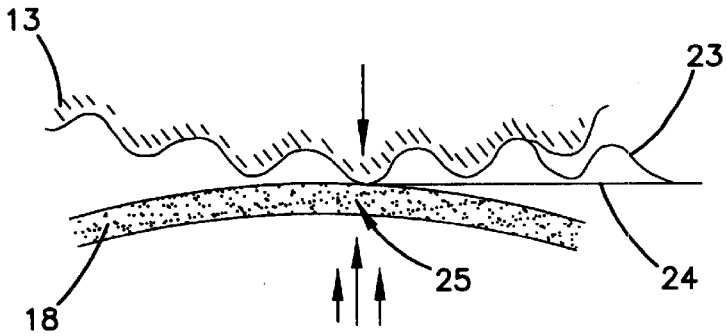
FIG. 3 PRIOR ART
Figure 6:
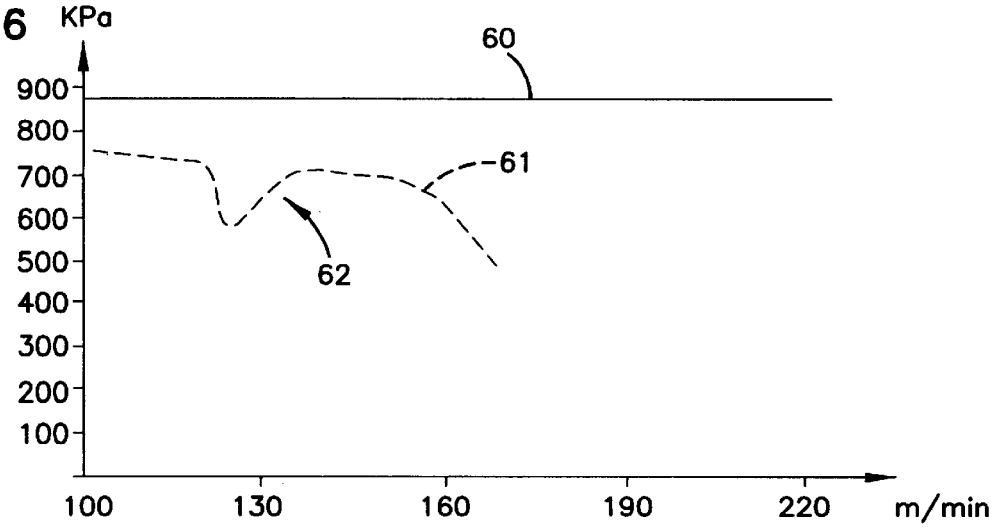
FIGS. 6, 7 and 8 are diagrams giving the characteristics of burst resistance of various qualities of double-face corrugated paperboard, using a single-face paper obtained from a known machine of the type described with reference to FIG. 1 (in broken lines) and from the machine according to the invention (in solid lines), as a function of the speeds of advance.
Figure 7:
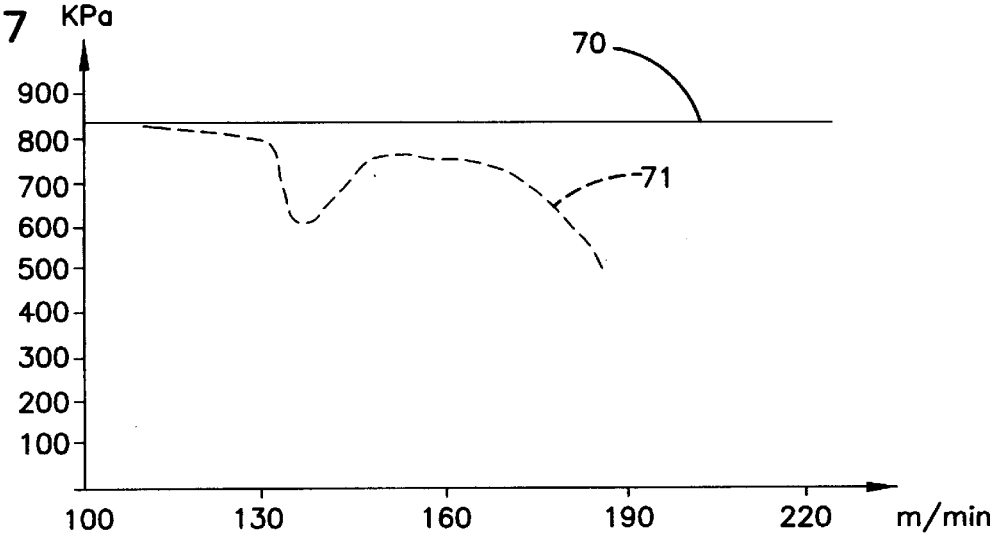
Figure 8:
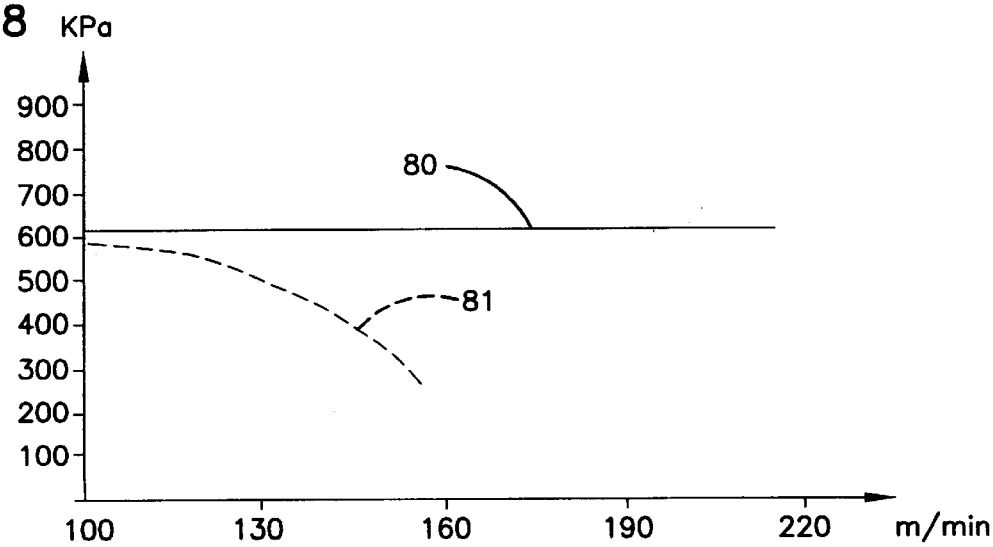

By way of example, the FIGS. 6, 7 and 8 represent curves giving the resistance to flat crushing or bursting as a function of speed, for speeds of advance lying between 100 and 230 m/min, for three different qualities of double-face board, in which the single-face base sheet was obtained using a machine of the prior art as described with reference to FIGS. 1 to 3 (in broken lines), and with a machine according to the embodiment of the invention more particularly described here, corresponding to FIGS. 4 and 5 (in solid lines).

The resistance is expressed in kilopascals.

The references of the papers used are, in order, the specifications of the plane cover sheet, of the fluted sheet, and of the second plane sheet supplementing the single face, in order to form the double-face sheet.

The capital designation letters correspond to French standard NF Q 01005 and, in particular:

T denotes the paper commonly called Test Liner by the person skilled in the art;

K denotes the paper known by the designation KRAFT paper;

C denotes recycled fluted paper;

H denotes treated recycled fluted paper; and

R denotes ordinary paper for flutes.

The number appearing after the capital letter gives the grammage of the paper in grammes per $m^2$.

FIG. 6 relates to a paper of quality T150/C110/T150.

With the invention (curve 60) the burst resistance characteristics are substantially retained regardless of the speed in the range examined.

The invention thus allows a gain of +12% at 100 m/min and +20% at 160 m/min, relative to that which is obtained with a conventional, so-called smooth press machine (curve 61).

In the case of a conventional machine, the board obtained in the vibration zone (zone 62) moreover has poorer strength, and the production limit is quickly reached below 160 m/min, in contrast to the board obtained with the invention, which substantially preserves its characteristics above 200 m/min, and its qualities are unaltered in the vibration zone.

FIGS. 7 and 8 relate to two other board qualities, namely sheets of T200/H150/T200 and R100/C110/R100 corrugated board.

The curves obtained, respectively 70 and 71 and 80 and 81, attract the same comments as the curves 60 and 61 hereinabove.

As is self-evident and as moreover emerges from the above description, the present invention is not limited to the embodiment more particularly envisaged. It also relates, in particular, to the cases in which the positive drive means exerting tension and located entirely downstream of the second cylinder are inter-roll pinching means made of elastic material, belt drive means bearing on plane or cylindrical sheet metal, or on another belt, and the cases in which the complementary heating means consist of a heating table or of an electrical dryer or an infrared dryer.

We claim:

1. Machine for manufacture of a sheet of single-face corrugated board by gluing a fluted sheet of board onto a plane sheet of board, comprising:

three heating cylinders, each having an external wall, which are substantially tangential in pairs and have parallel axes, namely a first, fluted cylinder for performing the fluted sheet, a second, fluted central cylinder fitted with means for applying the fluted sheet against the external wall of said second cylinder upstream of a first contact between the plane sheet and the fluted sheet, and a third, smooth cylinder for bringing the plane sheet into contact with the flutes of the fluted sheet at the periphery of the said second cylinder;

and means for gluing said flutes before said contact, wherein said machine furthermore comprises a positive drive means, for positive driving by tension of said plane sheet of corrugated board, with a strength equal to or greater than 4N/cm, said positive drive means being located entirely downstream of the path of the corrugated board with respect to the three cylinders, said positive drive means and the second cylinder being arranged to press the fluted sheet flat onto the external wall of said second cylinder downstream of said first contact between the plane sheet and the fluted sheet, along a circular arc corresponding to an angle alpha at the center of said circular arc of a first determined value greater than zero, said positive drive means being associated with means for complementary heating of said corrugated board and wherein said machine comprises means for adjusting a pressure exerted on the sheet of corrugated board, at the second cylinder, by the third, smooth cylinder, below 3 kg/cm.

2. Machine according to claim 1, wherein the means for complementary heating of the said corrugated board are separate from the positive tension means and are located upstream of the positive drive means, between said three heating cylinders and said positive drive means.

3. Machine according to claim 1, where the means for positive driving by tension of the sheet of corrugated board and the complementary heating means comprise a fourth heating cylinder provided with an application means for applying the sheet of corrugated board against the external wall of the said fourth cylinder, said fourth cylinder having an axis generally parallel to the other cylinders, the said fourth cylinder being arranged to be itself in contact with the back of the plane sheet over a circular arc corresponding to an angle beta at the center of said circular arc of a second determined value greater than zero.

4. Machine according to claim 3, characterized in that the second determined value lies between 90° and 270°.

5. Machine according to claim 4, characterized in that the second determined value is approximately 180°.

6. Machine according to claim 5 characterized in that the application means associated with the fourth cylinder are means for suction of the corrugated board, via orifices pierced in the surface of the wall of the said fourth cylinder.

7. Machine according to claim 6, characterized in that the positive drive means comprise means for actuating the fourth cylinder in rotation at a determined speed lying between 1 and 1.05 times the speed of rotation of the second cylinder.

8. Machine according to claim 7, characterized in that it furthermore comprises a smooth cylinder of small diameter, of axis parallel to the axis of the said heating cylinders, and located downstream of the said cylinders on the path of the corrugated board and below the horizontal plane tangential to the upper generatrix of the fourth cylinder.

9. Machine according to claims 8, characterized in that the fourth cylinder is arranged to allow adjustment of the angle beta of winding of the sheet of corrugated board onto the said fourth cylinder.

10. Machine according to claim 9, characterized in that the first determined value alpha is greater than 30°.

11. Machine according to claim 10, characterized in that the first determined value alpha is greater than 100°.

12. Machine according to claim 9, characterized in that the first determined value corresponds to an arc dimension at the surface of the second cylinder greater than 50 mm.

13. Machine according to claim 12, characterized in that it comprises means for adjusting the distance between the surfaces of the second and third cylinders, the said means being arranged to eliminate any pressure of the third cylinder on the fluted sheets and plane cover sheet of the corrugated sheet, in contact with the second cylinder, during operation of the machine.

14. Machine according to any one of the preceding claims, characterized in that the positive drive means and the second cylinder are arranged to allow adjustment of the angle alpha of winding of the sheet of corrugated board onto the second cylinder.

15. Method for manufacturing a sheet of single-face corrugated board comprising the steps of:

feeding a sheet of board material between first and second heating corrugated cylinders to form a fluted board around said second heating cylinder having an axis, said fluted board having parallel flutes presenting crests parallel to said axis of said second cylinder, pasting the crests of the flutes of the corrugated sheet with glue, bringing into contact with said crests a plane sheet which is supplied by conveying means, keeping said crests in contact with the plane sheet over a first zone formed by a first surface portion of said second cylinder, by pressing the fluted sheet of the sheet of single face corrugated board against the first surface portion, downstream of the first contact between the plane sheet and the fluted sheet, over a first arc corresponding to a first subtended angle alpha of a first determined value greater than zero, exerting a traction or tension approximately equal to or greater than 4N/cm on said plane sheet of the sheet of single face corrugated board by positive driving of said sheet of single face corrugated board entirely downstream of the path of said sheet of single face corrugated board with respect to the second cylinder, heating said sheet of single face corrugated board in complementary fashion over the path of said sheet of single face corrugated board, located entirely downstream with respect to said second cylinder, and exerting a pressure on the sheet of corrugated board, at the second cylinder, by the third smooth cylinder, below 3 kg/cm.

16. Method according to claim 15, comprising the step of pressing said plane sheet against a second surface portion of a rotary heating smooth fourth cylinder located entirely downstream of the path of the corrugated board with respect to the second cylinder, over an arc corresponding to a second subtended angle beta of a second determined value, to exert said tension and provide said complementary heating.

17. Method according to claim 16, wherein the second determined value is between 90° and 270°.

18. Method according to claim 17, wherein the second determined value is approximately 180°.

19. Method according to claim 18, wherein the rotational speed of said fourth heating cylinder is between 1 and 1.05 times the speed of rotation of said second cylinder.

20. Method according to claim 19, wherein the first determined value is greater than 30°.

21. Method according to claim 20, wherein the first determined value is greater than 100°.

22. Method according to claim 21, wherein no external pressure is exerted by the conveying means of the plane cover sheet.

23. Method according to claim 22, comprising the step of adjusting during operation the first subtended angle alpha onto the second cylinder.

* * * * *